US007421807B2

(12) United States Patent
Condie

(10) Patent No.: US 7,421,807 B2
(45) Date of Patent: Sep. 9, 2008

(54) FOOTWEAR FOR USE DURING OR AFTER A PEDICURE AND METHOD OF USING SAME

(75) Inventor: Melissa C. Condie, St. Louis, MO (US)

(73) Assignee: Eidnoc Enterprises, L.L.C., St. Louis, MO (US)

( * ) Notice: Subject to any disclaimer, the term of this patent is extended or adjusted under 35 U.S.C. 154(b) by 0 days.

(21) Appl. No.: 11/363,980

(22) Filed: Feb. 28, 2006

(65) Prior Publication Data

US 2007/0068045 A1 Mar. 29, 2007

Related U.S. Application Data

(60) Provisional application No. 60/720,261, filed on Sep. 23, 2005.

(51) Int. Cl.
*A43B 3/24* (2006.01)
*A43C 13/14* (2006.01)

(52) U.S. Cl. ..... 36/101; 36/72 R; 36/77 R

(58) Field of Classification Search ..... 36/77 R, 36/72 R, 101
See application file for complete search history.

(56) References Cited

U.S. PATENT DOCUMENTS

| | | | | |
|---|---|---|---|---|
| 2,506,308 | A | 5/1950 | Maynier | |
| 2,507,120 | A * | 5/1950 | Shapiro | 36/11.5 |
| D159,662 | S | 8/1950 | Patek | |
| 2,740,207 | A * | 4/1956 | Starensier | 602/31 |
| 2,751,691 | A | 6/1956 | Clark, Jr. | |
| 2,751,693 | A | 6/1956 | Baker | |
| 3,436,843 | A | 4/1969 | Sachs | |
| 3,716,932 | A * | 2/1973 | Pakulak | 36/72 R |
| 4,017,987 | A | 4/1977 | Perez, Jr. et al. | |
| 4,177,583 | A | 12/1979 | Chapman | |
| D260,047 | S | 8/1981 | Heinz | |
| D271,156 | S | 11/1983 | Williamson | |
| D297,380 | S * | 8/1988 | Schine | D2/907 |
| 5,623,734 | A | 4/1997 | Pugliatti | |
| 5,778,565 | A | 7/1998 | Holt et al. | |
| 5,870,837 | A | 2/1999 | Poulos | |
| 5,926,978 | A | 7/1999 | Smith | |
| 5,946,823 | A | 9/1999 | Yates | |
| 6,151,801 | A | 11/2000 | Frederiksen et al. | |
| 6,226,893 | B1 | 5/2001 | Schlamp et al. | |
| 6,360,457 | B1 | 3/2002 | Qui et al. | |
| D468,056 | S | 12/2002 | Goldberg et al. | |
| 6,678,971 | B2 | 1/2004 | Brooks | |
| 6,874,256 | B2 | 4/2005 | Delgatty | |
| 2006/0064902 | A1 * | 3/2006 | Ashton | 36/72 R |

FOREIGN PATENT DOCUMENTS

| | | |
|---|---|---|
| DE | 35 30511 A1 | 3/1987 |

* cited by examiner

*Primary Examiner*—Ted Kavanaugh
(74) *Attorney, Agent, or Firm*—Brian B. Diekhoff; Polsinelli Shalton Flanigan Suelthaus PC

(57) ABSTRACT

Footwear is described for use during or after a pedicure. The footwear includes a main body for receiving a foot and a toe cover that is repeatedly detachable and attachable to the main body or a sole of the footwear. A rear portion of the footwear wraps around a rear of the foot to stabilize the foot. An upper surface of the footwear forms an opening through which the toes are extended. The upper surface also covers a portion of the foot and reduces or inhibits the upward movement of the toes. The toe cover rests on the upper surface.

16 Claims, 16 Drawing Sheets

FOOTWEAR FOR USE DURING OR AFTER A PEDICURE AND METHOD OF USING SAME

This application claims the benefit of U.S. Provisional Patent Application No. 60/720,261 filed Sep. 23, 2005.

FIELD OF THE INVENTION

The invention relates to footwear for use during or after a pedicure and method of using the footwear.

BACKGROUND OF THE INVENTION

The value of looking good cannot be underestimated. Careful clothing selection and good personal hygiene can help people not only to feel more confident about themselves, but can actually improve the way that others see and react to them.

Spa treatment for protection of the skin, nails, and hair is becoming more of a necessity than a luxury for many, and the commonality of spa treatments for both women and men is increasing dramatically. Pedicures, in particular, have recently grown in popularity to promote foot health as foot pain from improper care of feet is a well known, and potentially dangerous, concern. The experience of a pedicure also can be very relaxing, and the results are usually having cleaner, more attractive feet and toenails. Often, the main objective of having the pedicure is the cosmetic improvement of the toenails.

For most women (and some men), a pedicure is usually culminated by painting of the toenails. This can provide both personal enjoyment and can improve the appearance of the feet when wearing open toed shoes—which has become as often as possible for many women. Regardless of the aesthetic benefits, painted toenails can both provide for protection of the nails and an enhanced appearance to the feet, as well as complementing or accenting other clothing or personal decoration.

A pedicure, however, is generally not a quick or inexpensive procedure, particularly when professionally performed. Taking time off from other activities to have the procedure done, as well as paying a professional for the service, means that the recipient wants the benefits of the procedure to last for as long as possible and the most professional look obtainable. To insure that nail polish lasts as long as possible and has the best appearing presentation, it is often required not only that the user spend the time and money to have the pedicure performed professionally, but also to spend a fairly large amount of time after the procedure protecting the nails and the nail polish from any possibility of damage to get the best look.

Many pedicure recipients are extra cautious about their feet, and particularly their toenails, for hours after a pedicure to insure that the polish is completely dry before resuming normal activities to prevent any damage or imperfections in the polish. They will often walk very diligently, sometimes with a flatfooted or other uncomfortable gait, and will usually try to keep their distance from any tangible object that could contact their feet. Any contact of the feet to another object is potentially hazardous to the pedicure. If the individual is not extra cautious, any contact can result in polish damage such as, but not limited to, smearing or streaking or other unintended removal of a portion of the polish. Open-toed shoes may also expose the polish to particulate imperfections such as dust, which can become lodged in the polish, spoiling its surface properties.

This risk of damaging the pedicure is not eliminated by the wearing of traditional footwear, and, in fact, the wearing of traditional footwear will likely damage the pedicure. While footwear may protect the polish from direct interaction with outside concerns, outside contact with the footwear can cause the foot to shift in the shoe or the shoe to shift relative to the foot, causing interaction between the nails and the interior of the shoe, which can be just as damaging to the polish. This interaction can also be caused by the simple act of walking as the feet and toes will commonly move within footwear to provide for a comfortable stride. These are some of the reasons why people do not wear traditional footwear after a pedicure.

Damage to the toenail polish can come from a large number of sources, many of which a person has no control over. Feet can be impacted by dogs, cats, children, or other people who inadvertently kick, brush, or step on the toes. More commonly, polish can be damaged by walking into or scraping against objects or by walking where particulates are present such as sand, grass, or even carpet. Inclement weather conditions such as snow, rain, puddles, wind blown debris or the like can also present problems.

The number of possible concerns from damage to nail polish arises principally because many nail polishes take a significant amount of time to completely set, even if they are dry to the touch in a matter of minutes. Before it is fully cured, all polish risks damage. Further, even once completely dry, polish may be scuffed, smeared or damaged from a heavy impact.

To insure that polish appears the best as possible, people will often plan to be as sedentary as possible after a pedicure in order to avoid damage to the toenails. While simply being sedentary is a fairly effective solution, most people in today's society are too busy to make time for "less movement" to allow nail polish to dry. This means that many people simply forgo the pedicure to save the time and the hassle of having to protect the nails. On those rare occasions when they actually do get a pedicure, many people forget to be as cautious as necessary during the post-pedicure period because they are not in the habit of doing so. This can lead to damage to the nails and frustration that they had the special occasion of the service, paid for a service, and took time out of their schedule to have the service rendered only to have the result damaged. As a result, many people decide to stop receiving pedicures as often as preferred, and in some cases, indefinitely.

SUMMARY OF INVENTION

The present invention relates to footwear for use during or after a pedicure. The footwear includes a main body for receiving a foot and a toe cover that is repeatedly detachable and attachable to the main body or a sole of the footwear. A rear portion of the footwear wraps around a rear of the foot to stabilize the foot. An upper surface forms an opening through which the toes are extended. The upper surface also covers a portion of the foot and reduces or inhibits the upward movement of the toes. The toe cover rests on the upper surface.

The shoe generally stabilizes the foot and prevents the toes of the wearer from contacting the toe cover. The toe cover rests on the upper surface. The shoe bends or flexes without the toes contacting the toe cover. The toe cover contains, covers, and protects the toes of the wearer of the shoe.

The method of wearing footwear of the present invention includes wearing the footwear with the removable toe cover. The footwear includes the rear portion that wraps around the rear of the foot to stabilize the foot. The footwear includes the upper surface forming the opening through which the toes are extended. The upper surface covers a portion of the foot, and the upper surface reduces or inhibits the upward movement of the toes. The method further includes detaching the toe cover, performing a pedicure on the wearer, and attaching the toe cover to rest on the upper surface of the shoe.

DESCRIPTION OF THE PREFERRED EMBODIMENT(S)

Figure 1:
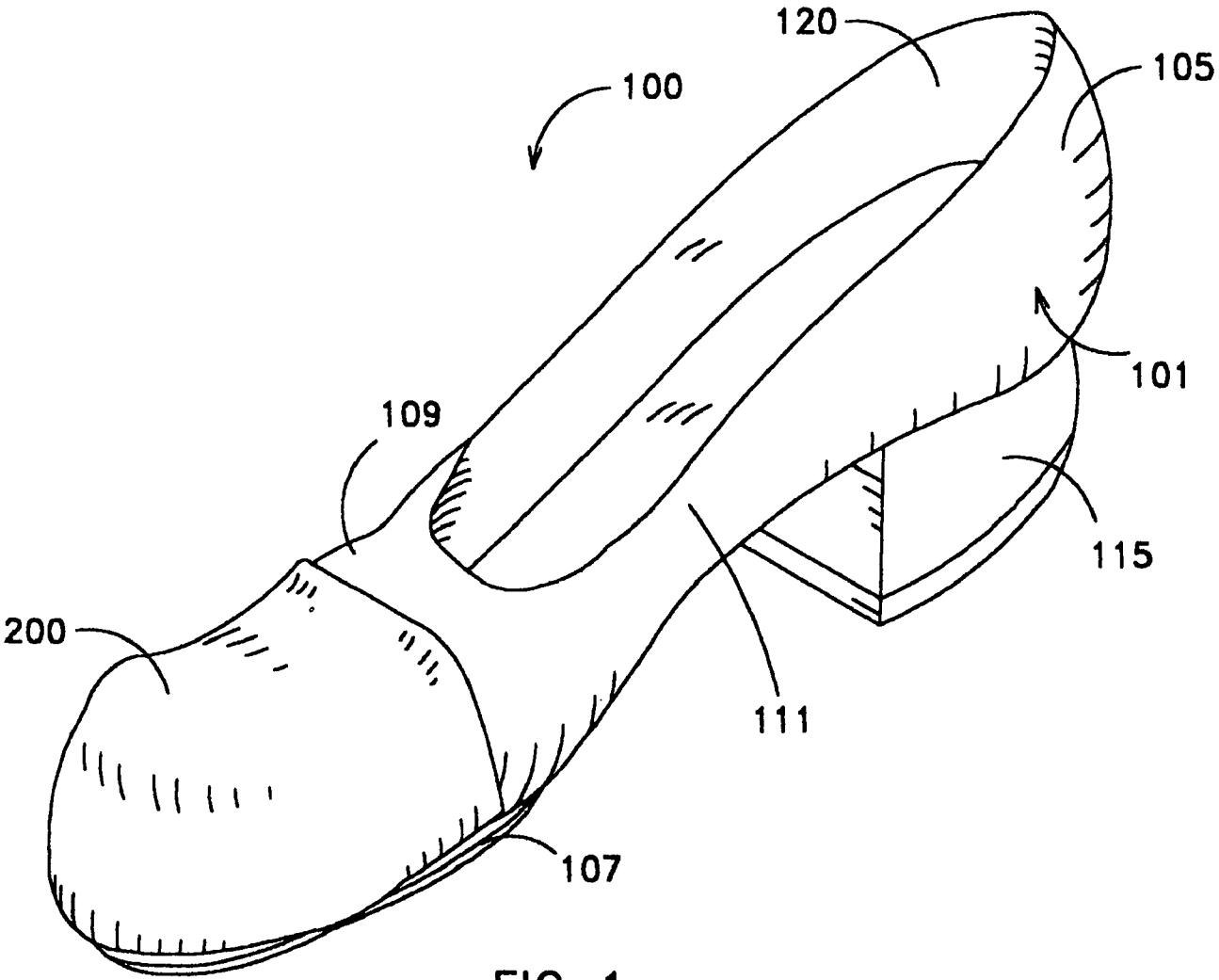
FIG. 1 shows a perspective view of the shoe with the toe cover attached.

Described herein is footwear designed specifically to protect toenails from inadvertent contact both from outside sources and from contact with internal structures of the footwear itself for use during and after a pedicure. The footwear is generally in the form of shoes, however, boots, moccasins, slippers or other types of footwear may be constructed according to this invention. The footwear utilizes a two piece construction, whereby the toes can be exposed from the footwear before the nails are painted, and then can later be contained in the shoe to protect them from movement and potential damage.

The shoe 100 generally comprises two main parts, a main body 101 and a removable toe cover 200. The main body 101 of the shoe 100 also generally includes an upper surface 109 which will serve to hold the toes toward a sole 107 and inhibits or reduces the upward movement of the toes. The upper surface 109 limits the usual range of upward mobility for the toes, to reduce its likelihood of contacting the toe cover 200 and damaging the painted nails.

Figure 2A:
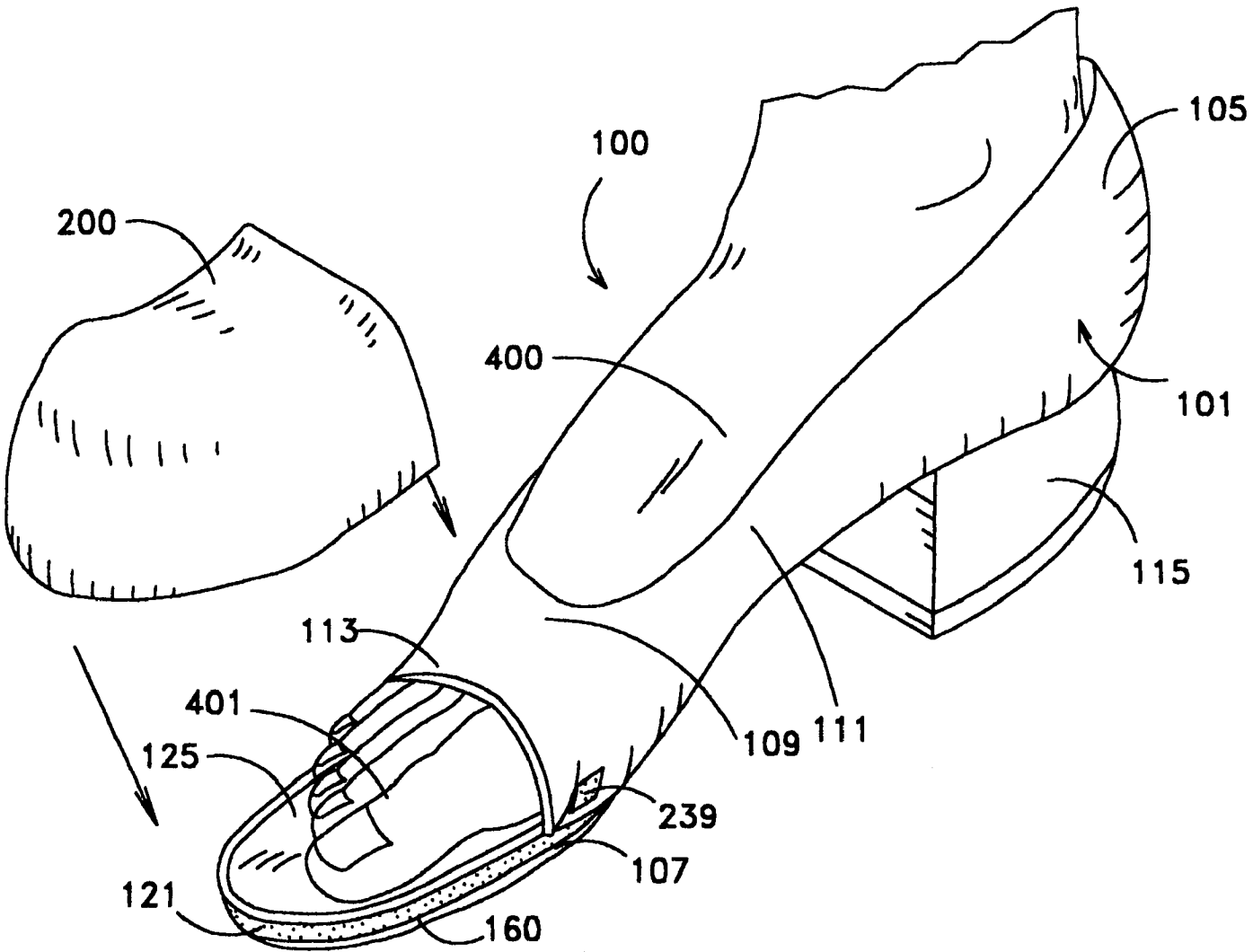
FIG. 2(A) shows a perspective view of the shoe with the toe cover being attached.
Figure 2B:
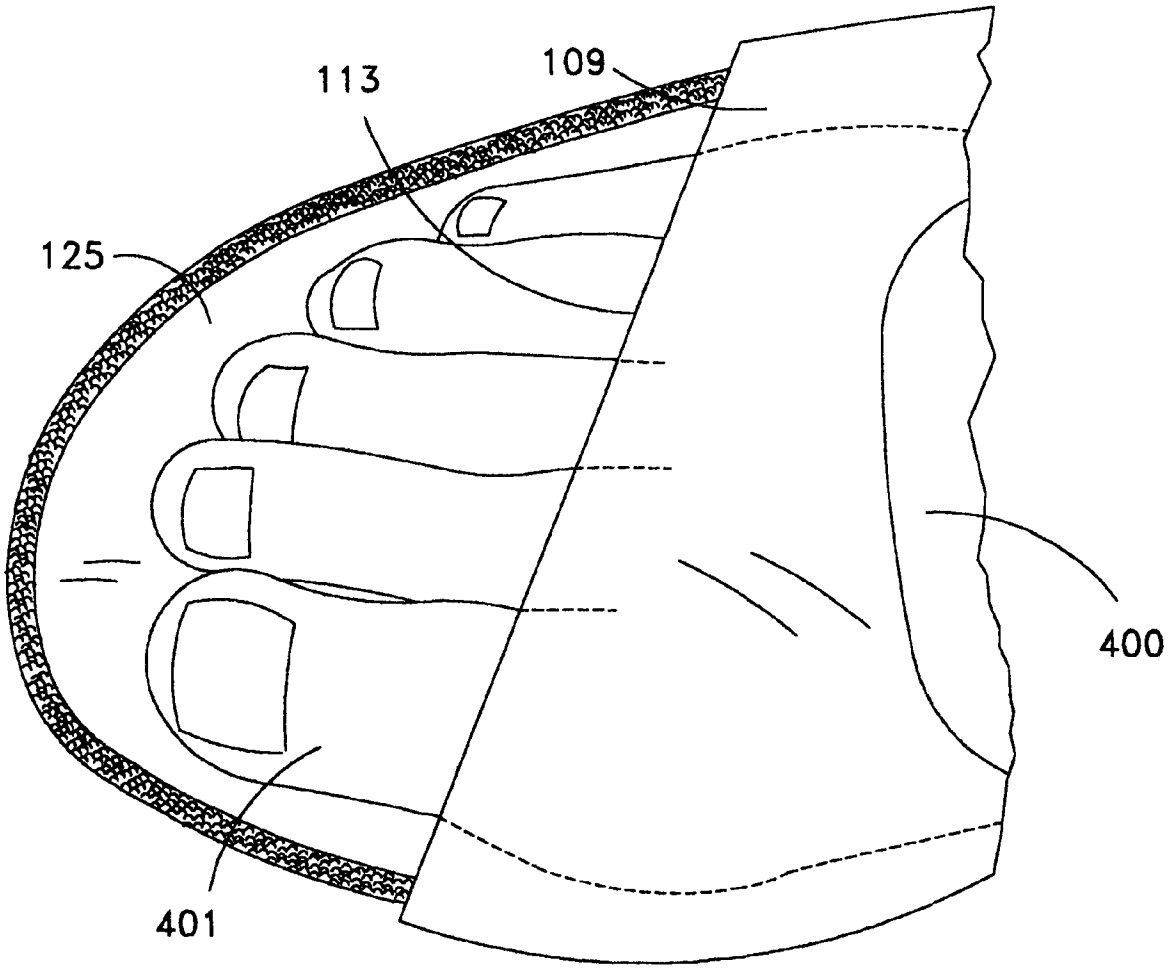
FIG. 2(B) shows a close-up view of the shoe with the toe cover removed revealing the toes.
Figure 3:
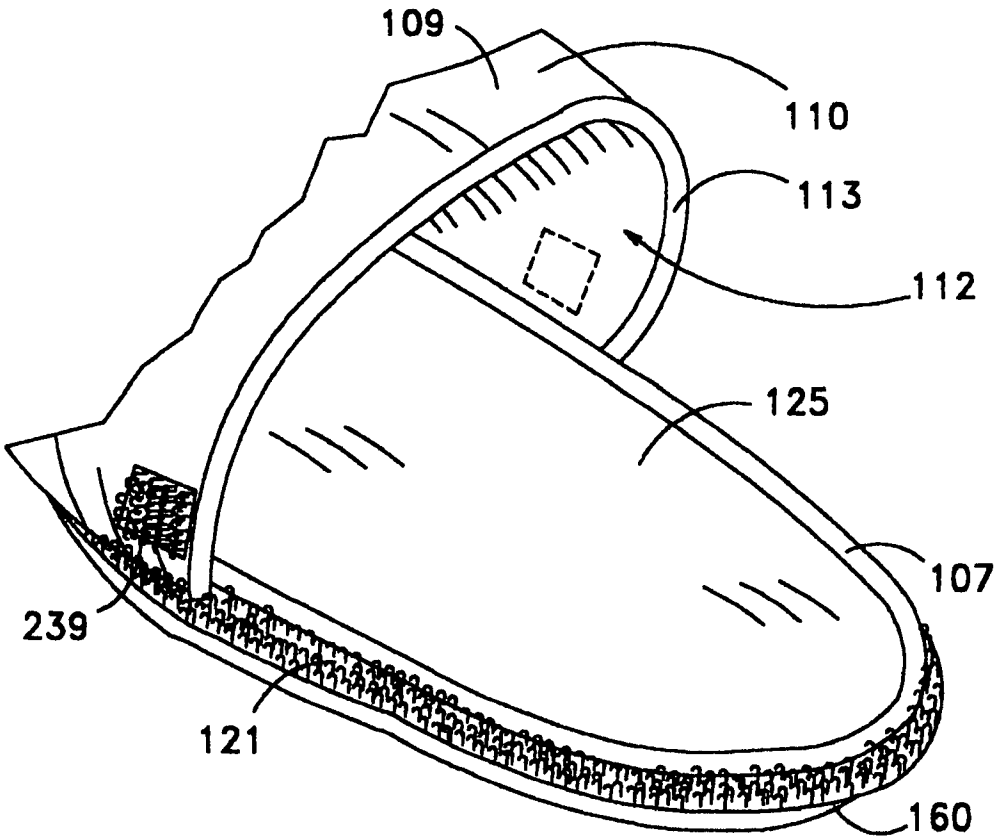
FIG. 3 shows a perspective view of the front of the shoe with the toe cover removed.
Figure 4:
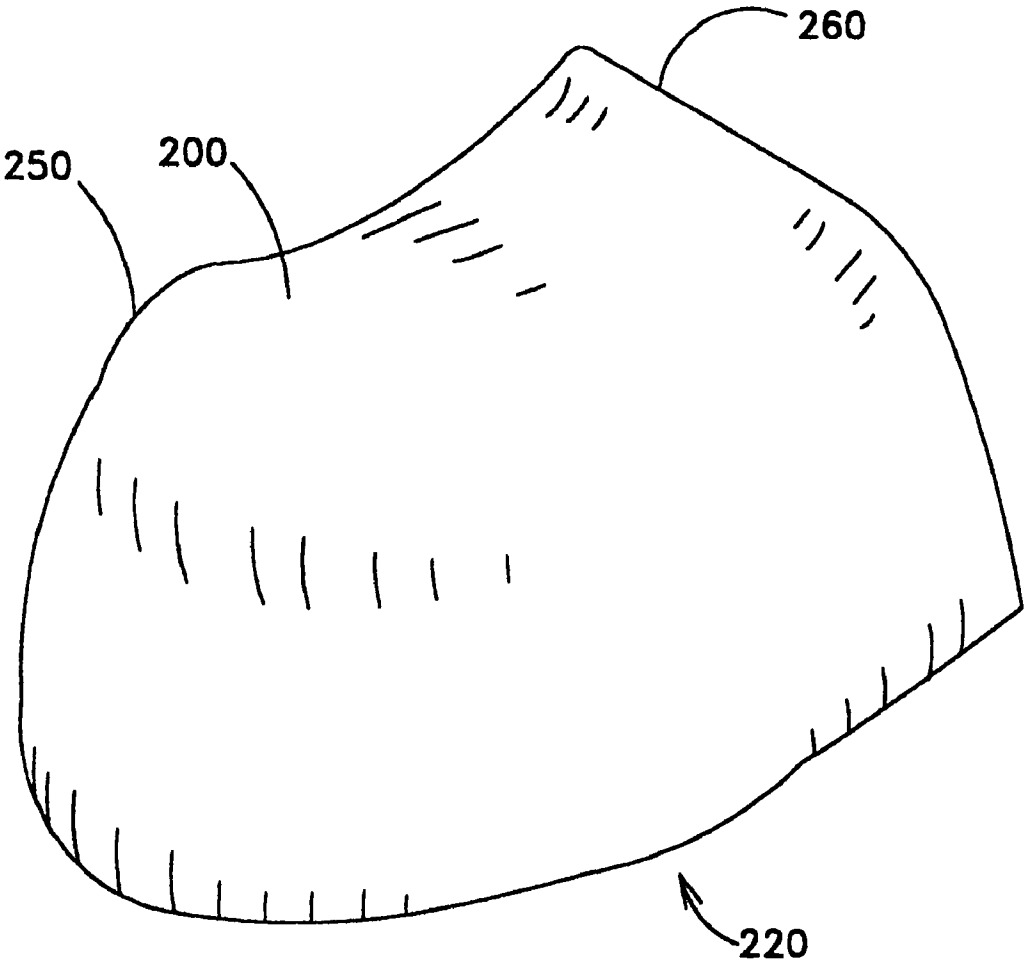
FIG. 4 shows a perspective view of the toe cover.
Figure 5:
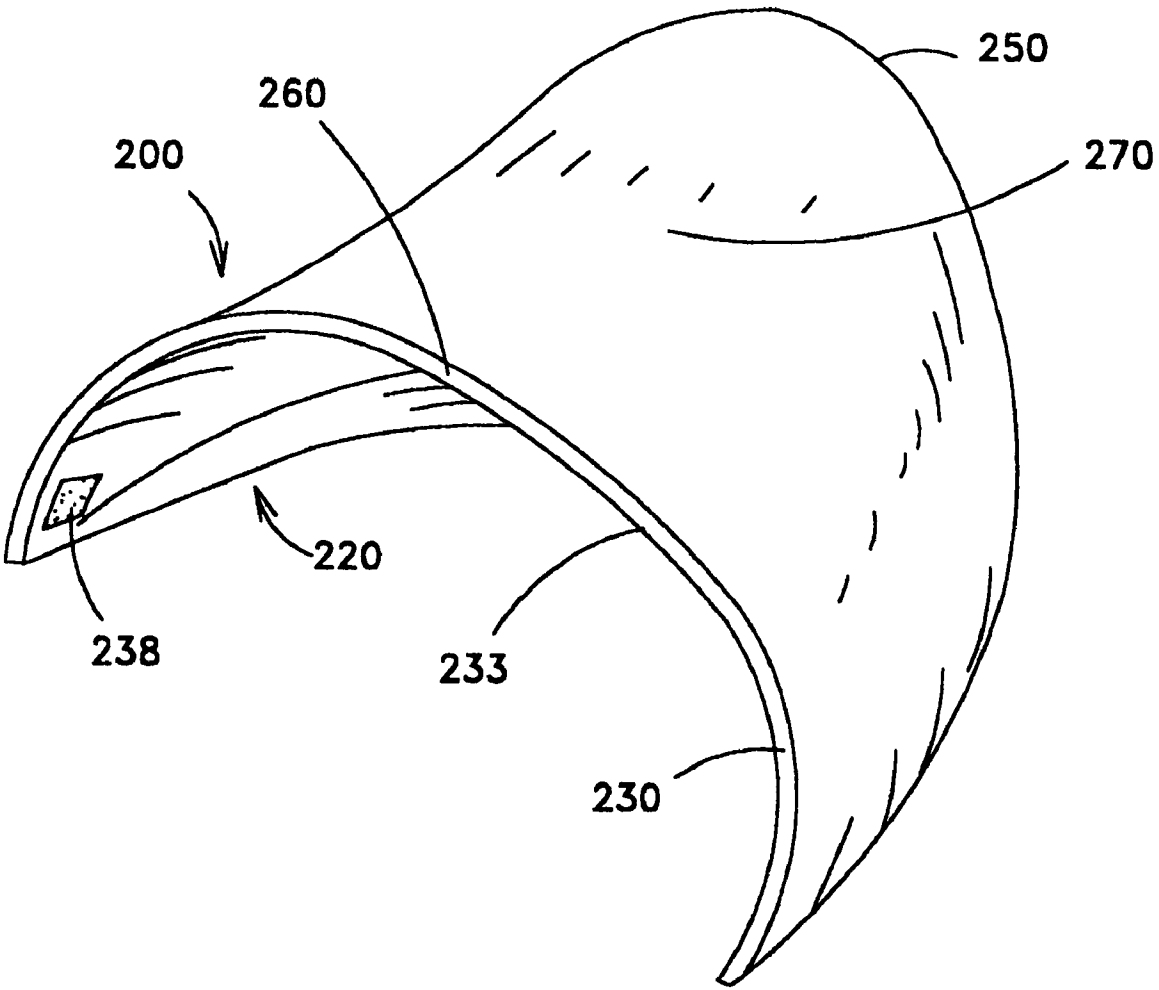
FIG. 5 shows a rear view of the toe cover.
Figure 6:
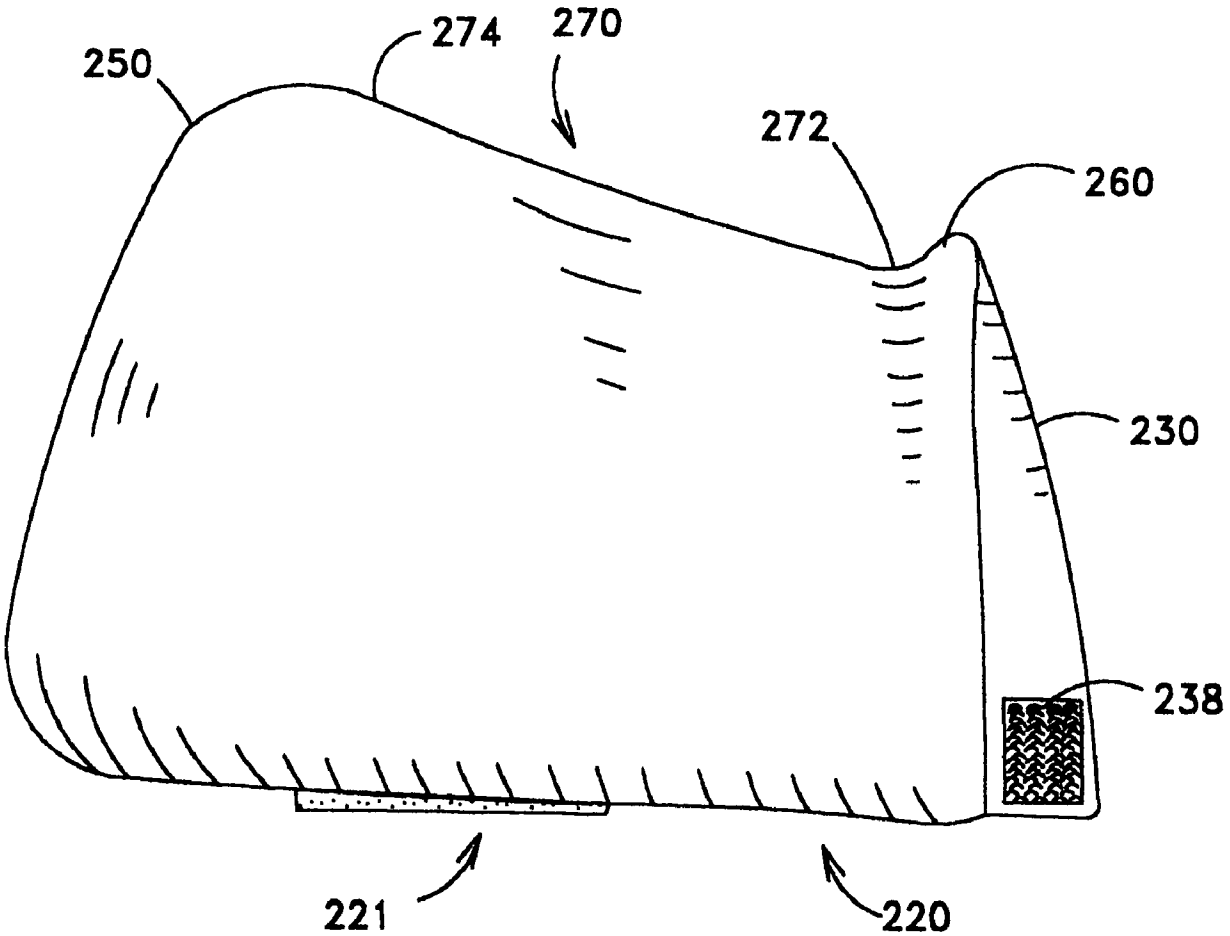
FIG. 6 shows a side view of the toe cover.
Figure 7:
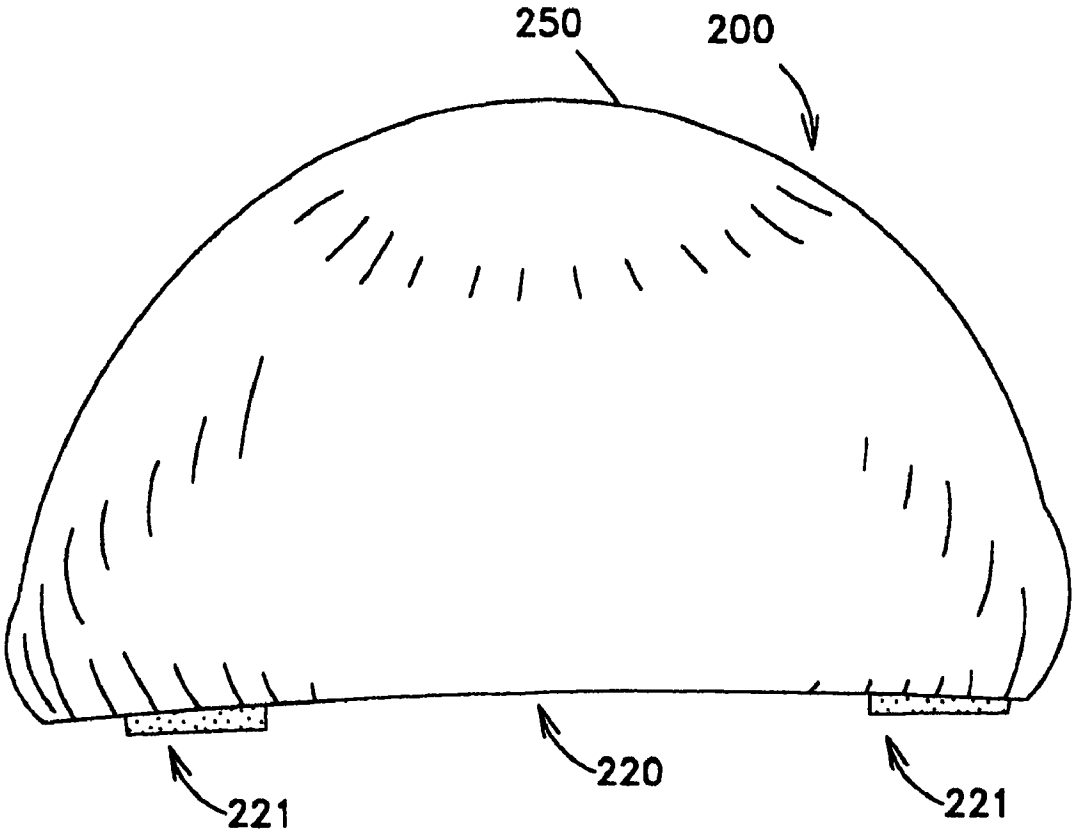
FIG. 7 shows a front view of the toe cover.
Figure 8:
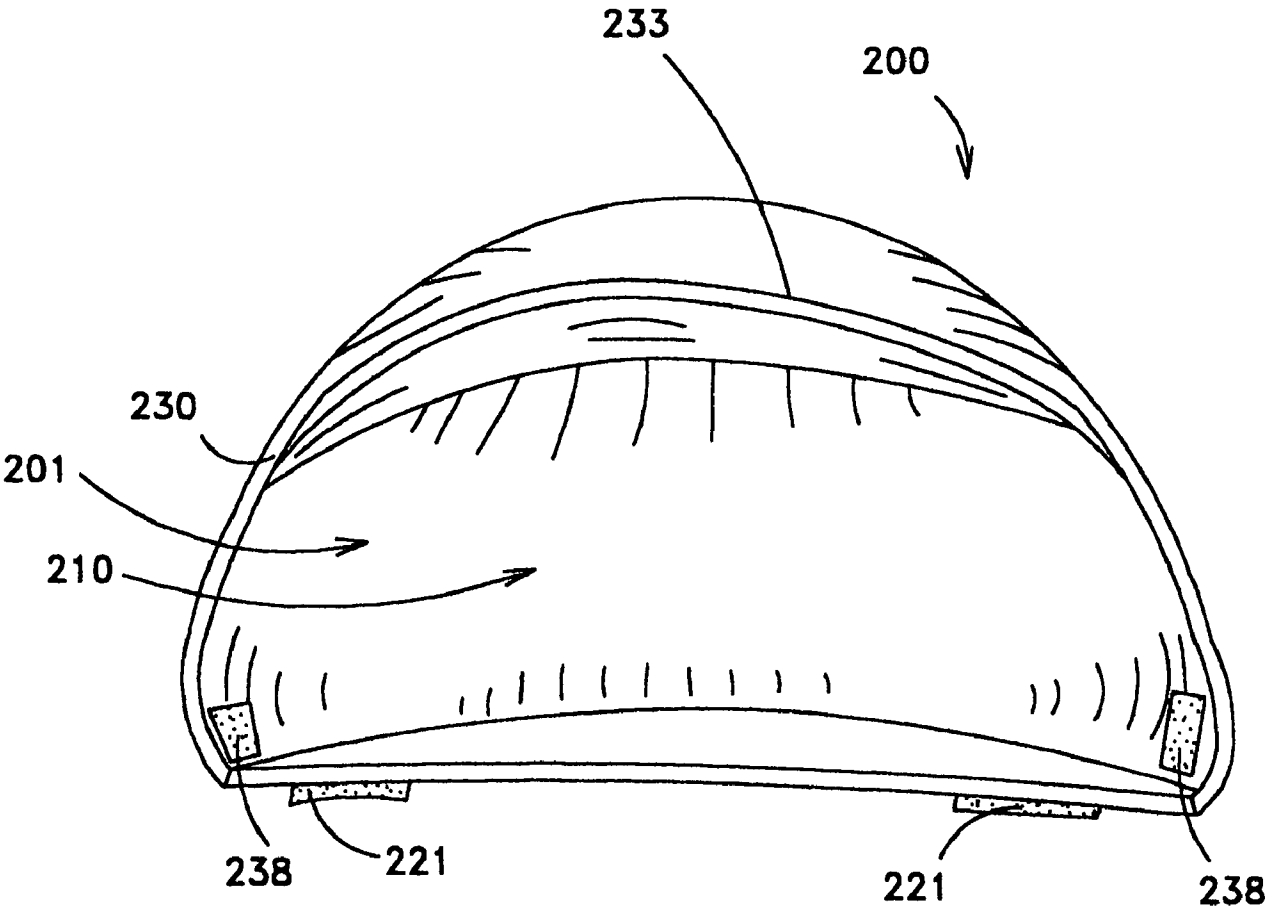
FIG. 8 shows a rear view of the toe cover.
Figure 9:
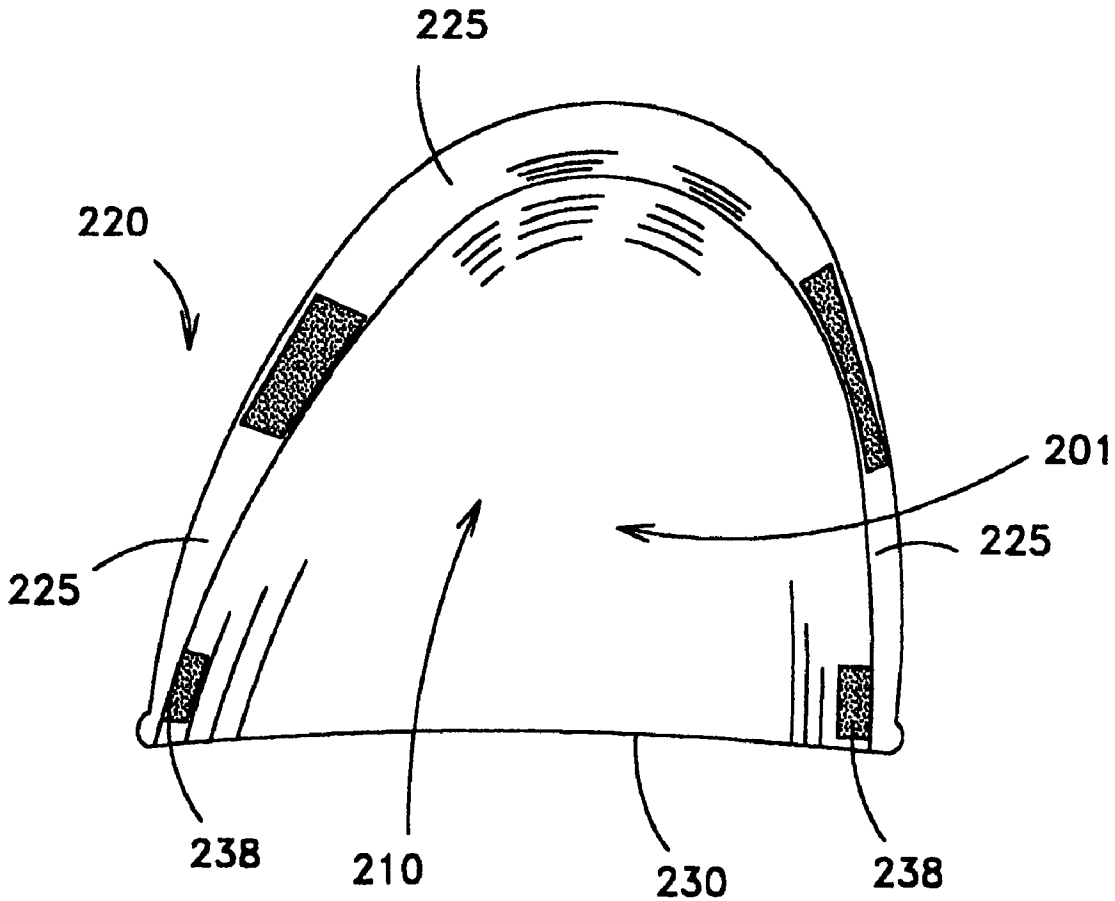
FIG. 9 shows a bottom view of the toe cover.

Certain embodiments of the shoe 100 designed to inhibit toenail polish damage are exemplified in FIGS. 1 through 3. The shoe 100 generally has two parts, the main body 101 which comprises most of the shoe 100 and forms most of its structure and the toe cover 200 which removably attaches to the main body 200 so as to expose or cover the toenails. Generally, the shoe 100, when the main body 101 and toe cover 200 are assembled, resembles a lady's pump, with a marginally higher front section in comparison to similarly shaped shoes. The shoe 100 would be appropriate work attire for many professional women. In other embodiments, the shoe 100 may be constructed to resemble any type of footwear such as a loafer, flat, or something of this type, but the pump type of footwear is preferred because it is generally acceptable for wear with a wide variety of clothing and encases most of the foot to provide for additional protection.

The main body 101 is generally designed to restrict foot movement relative to the structure of the shoe 100. In particular the shoe 100 is designed so that movement of the foot in the shoe 100 is relatively minimal. In this way, if the shoe 100 contacts an outside obstruction due to movement of the foot, the foot will not have the opportunity to bring the toenails into contact with the inner surface of the shoe 100.

So as to provide for foot restraint, the shoe 100 is generally constructed of a wrapping or enclosing design whereby material is placed around the rear and sides of the heel and front of the ankle, generally known as the hindfoot and midfoot so that material of the shoe 100 is placed to block movement of the foot relative to the shoe 100. Generally, the rear 105 of the shoe 100 will wrap or enclose the heel to prevent the heel from sliding backward relative to the sole 107 of the shoe 100. The sides 111 of the shoe 100 will also generally provide for a wrapping or enclosing structure of the heel and midfoot. The sides 111 will generally continue over the midfoot forming the upper surface 109 that limits the range of movement of the toes and keeps the foot from being able to lift from the sole 107 of the shoe 100. This upper surface 109 will generally also be in contact with the front of the ankle, or at least the top of the foot, to inhibit forward motion of the foot relative to the shoe. The sides 111, the rear 105, and the upper surface 109 stabilize the foot in the shoe 100. The sides 111, the rear 105, and the upper surface 109 generally define a foot opening 120 through which the user's foot is inserted. The upper surface 109 forms a toe opening 112 through which the toes are extended.

As is known to one of ordinary skill in the art, such forward inhibition may also be carried out by lacing and the use of a "tongue" resting on the upper surface of the midfoot or by specifically sized and shaped main body 101 designs. Alternatively, the shoe 100 may include lacing or structure that continues up the leg securing the shoe 100 to the calf such as the case with many boots.

The shoe structure of the main body 101 will generally be such that the sides 111 and upper surface 109 terminate in an edge 113 extending just partially over the beginning of the toes. The edge 113 forms an arcuate shape. The edge 113 extends from one side of the shoe 100 to the other side of the shoe 100. The edge 113 angles toward the rear of the shoe 100 on the side of the shoe with the smallest toe. Thus, the toenails will be fully accessible for the pedicure. The sole 107 will generally continue forward under the toes to the end of the shoe 100 providing support for, and a walking position of, the entire foot.

As should be apparent from FIGS. 1-3, when the main body 101 is placed on the foot without the toe cover 200 in place, the shoe 100 is open in the region of the toes. In particular, at least a portion of the top and sides of the toes and often the end portion of the main foot body is accessible. In this arrangement, the toenails are exposed and accessible which allows them to be painted or pedicured while the main body 101 is on the foot.

The toe cover 200 is repeatedly detachable and attachable to the main body 101 of the shoe 100. When the toe cover 200 is detached, a front region 125 of the shoe 100 upon which the toes rest is exposed. The toe cover 200 may attach or detach using any engaging mechanism known to one of ordinary skill in the art. In the depicted embodiment, strips of hook 121 and loop 221 fasteners (Velcro™) are used as the engaging mechanism between the toe cover 200 and the shoe 100. In other embodiments, the hook 121 and the loop 221 fasteners may be replaced by an alternative repeatedly removable attachment structure such as a removable adhesive, magnets, buttons, zippers, or other structures as known to those of ordinary skill.

The toe cover 200 is shown in detail in FIGS. 4-9. The toe cover 200 defines a cavity 210. The cavity 210 contains, covers, and protects the toes of the wearer of the shoe 100. The toe cover 200 is designed to allow the wearer to flex their toes and angle their toes upward in the cavity 210 as allowed by the upper surface 109, however, the toe cover 200 is designed to accommodate this movement without the toes touching the interior surfaces of the toe cover 200. The toe cover 200 is preferably provided with the shape described herein. A front 250 of the toe cover 200 is higher than a rear 260 of the toe cover 200. A top surface 270 of the toe cover 200 includes a concave surface 272. The concave surface 272 leads into an upwardly sloping surface 274 up to the higher front 250 of the toe cover 200. This combination of the concave surface 272, the upwardly sloping surface 274, and the height of the front 250, provide for the toe cover 200 to accommodate the range of flexion of the toes allowed by the upper surface 109 without the toes touching the toe cover 200. The toe cover 200 also provides an aesthetically pleasing appearance in which the toe cover 200 is shaped to re-establish itself with the contour of the foot by resting on top of the shoe. Thus, the toe cover 200 follows the contour of the shoe 200.

Figure 10:
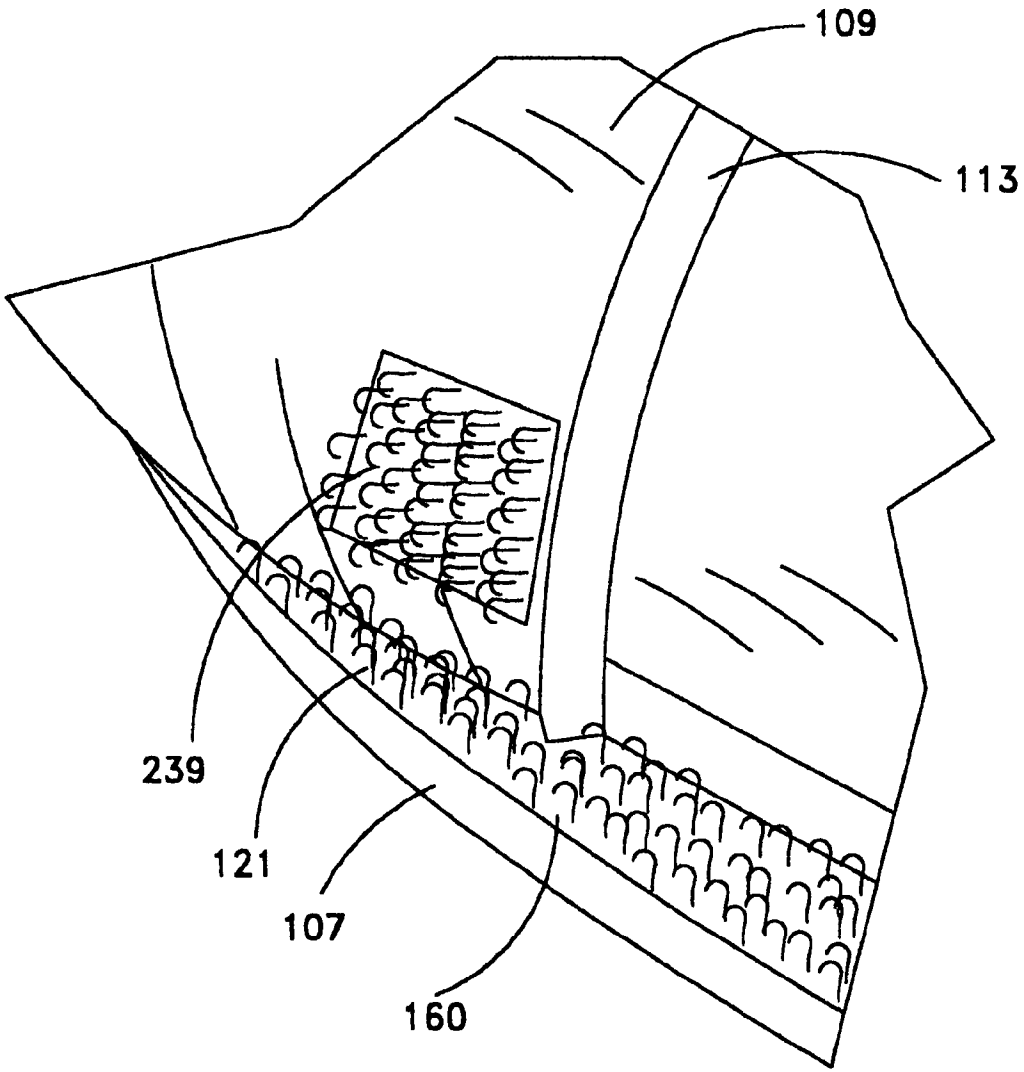
FIG. 10 shows a close-up view of the perimeter of the sole and the upper surface.
Figure 11:
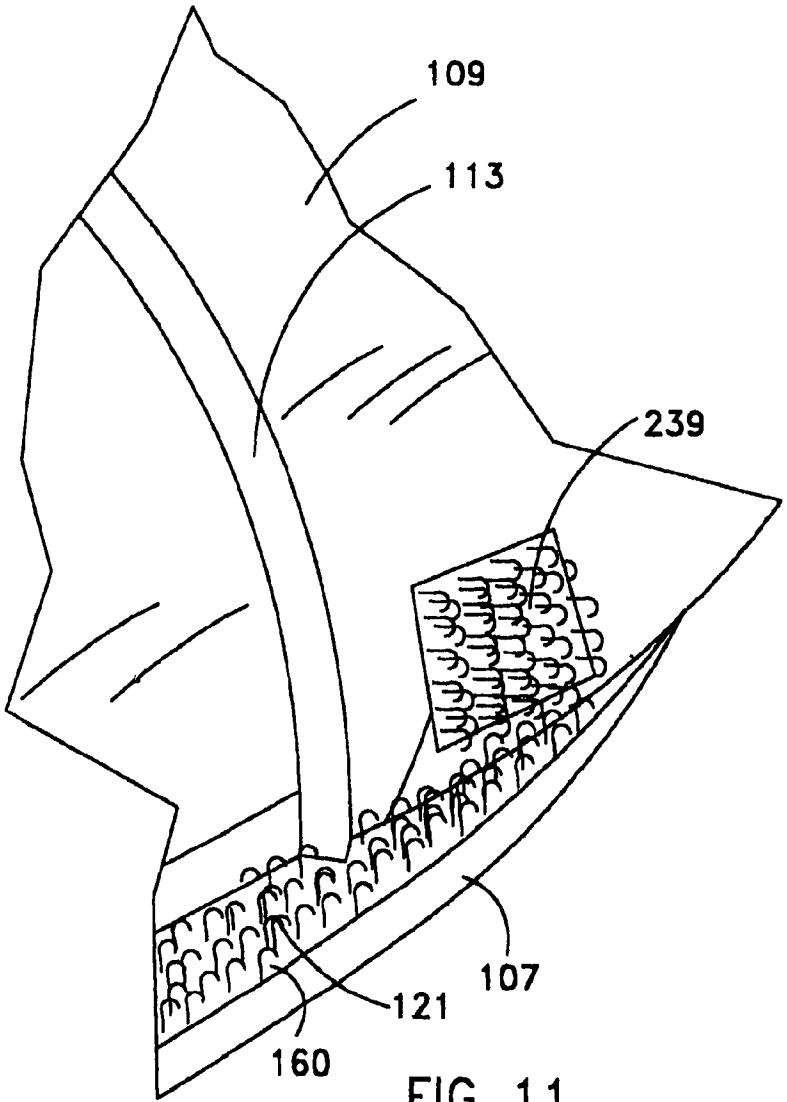
FIG. 11 shows another close-up view of the perimeter of the sole and the upper surface.
Figure 12:
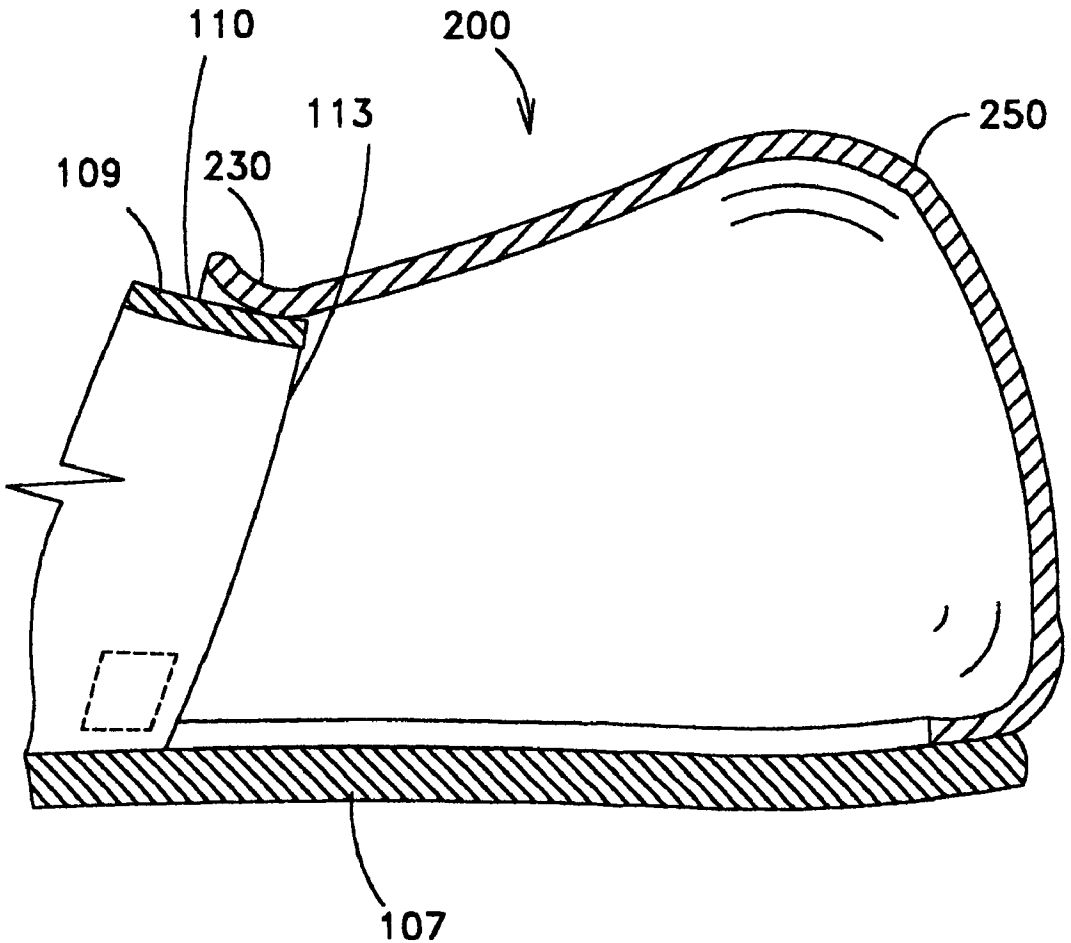
FIG. 12 shows a section view of the toe cover attached to the shoe.

The toe cover 200 includes an opening edge 230, which will rest upon the upper surface 109. The toe cover 200 further includes a bottom edge 220. The bottom edge 220 rests on a perimeter 160 of the sole 107. In other embodiments, the bottom edge 220 may rest directly on the sole or the region of the main body that supports the toes. The bottom edge 220 may include a flattened rim region 225 to receive the hook 121 and loop 221 fasteners. The bottom edge 220 may be continually or intermittently provided with the hook 121 and loop 221 fasteners. As exemplified in FIGS. 10 and 11, the perimeter 160 includes corresponding hook 121 and loop 221 fasteners to detachably receive the bottom edge 220. The perimeter 160 may also be continually or intermittently provided with the hook 121 and loop 221 fasteners. The hook 121 and loop 221 fasteners may also be recessed in the perimeter 160 of the shoe 200 for cosmetic reasons.

The opening edge 230 forms an arcuate shape to complement the arcuate shape of the edge 113. The opening edge 230 covers and rests upon the upper surface 109 of the shoe 100. A top section 233 of the opening edge 230 is not fixed or connected to a top surface 110 of the upper surface 109. This is important since the upper surface 109 and its top surface 110 need to flex and bend under the top section 233 of the opening edge 230 as the wearer walks. The top section 233 of the opening edge 230 should rest on the upper surface 109 just above a point of inflection for the toes 401. This allows the shoe to bend or flex without the toes contacting the toe cover 200 or forcing the toe cover 200 off of the shoe 100.

The hook 121 and loop 221 fasteners may cover the entire perimeter 160 or just a portion of the perimeter 160. The hook 121 and loop 221 fasteners may be used at a base 238 of the opening edge 230, but hook 121 and loop 221 fasteners should not cover the full length of the opening edge 230 or of the edge 113. Additional hook and loop fasteners may be used at a base 239 of the upper surface 109. The use of the hook 121 and loop 221 fasteners at the base 238 and the base 239 is optional. Also, the hook 121 and loop 221 fasteners at the base 238 and the base 239 may optionally be integrated into the hook 121 and loop 221 fasteners in the perimeter 160 or the bottom edge 220, respectively. It is important that the upper surface 109 be able to bend and flex under the toe cover 200.

The toe cover 200 is preferably made of a rigid, non-collapsible material. This prevents the toe cover from collapsing upon and damaging the recently pedicured toenails. The upper surface 109 of the shoe and the shoe 100 is preferably made of a softer more flexible material. This allows the shoe to flex and bend while the toe cover 200 remains generally in the original form. The toe cover 200 may have a porous structure to provide for ventilation.

Further, while the FIGS. all show the toe cover 200 being of generally rounded shape, this is by no means required and in alternative embodiments, the toe cover 200 may have an alternative shape. This is particularly relevant with the shoe 103 of FIG. 15 where a more angular or pointed shape may be desired to provide for a more upbeat design depending on current fashion trends.

The upper surface 109 will now be described in detail. The upper surface 109 holds and stabilizes the front of the foot. In a resting position, the upper surface 109 is not pulling or pressing upon the toes of the wearer. In a resting position, the upper surface is merely covering the foot. The upper surface 109 is generally not removable from the shoe 100. Instead, the upper surface 109 is a permanent and integral part of the shoe 100.

The front edge 113 of the upper surface 109 is specifically positioned to come across toes 401 to hold the toes 401 in place and thereby reduce or inhibit their upward movement. As shown in FIG. 2(B), it is desired that the edge 113 just pass over the beginning of all five toes 401, as opposed to covering an inch or more of the toes 401. The upper surface 109 will generally be sized and shaped so as to inhibit movement of the toes 401 upward as well as movement of the foot forward, generally by fitting relatively snuggly around the top of the toes 401.

As should be apparent from the above discussion, the shoe 100 provides for the ability to paint and pedicure the toes while the shoe 100 is on, and then to place the toe cover 200 over the toes so as to provide for protection of the nails. The forward region of the shoe 100 may also include additional structure to help keep the toenails from contacting the inside of the shoe structure. In particular, in the embodiment depicted in FIG. 13 there is included a toe retainer 301 that resiliently detains the toes in place against the sole 107 of the shoe. In this way, when the user walks, the toes are further inhibited from bending upward and contacting the toe cover 200. The toe retainer 301 is attached to the sole 107. The toe retainer 301 in FIG. 13 is designed to retain the toe by holding the toe to the sole 107.

Figure 13:
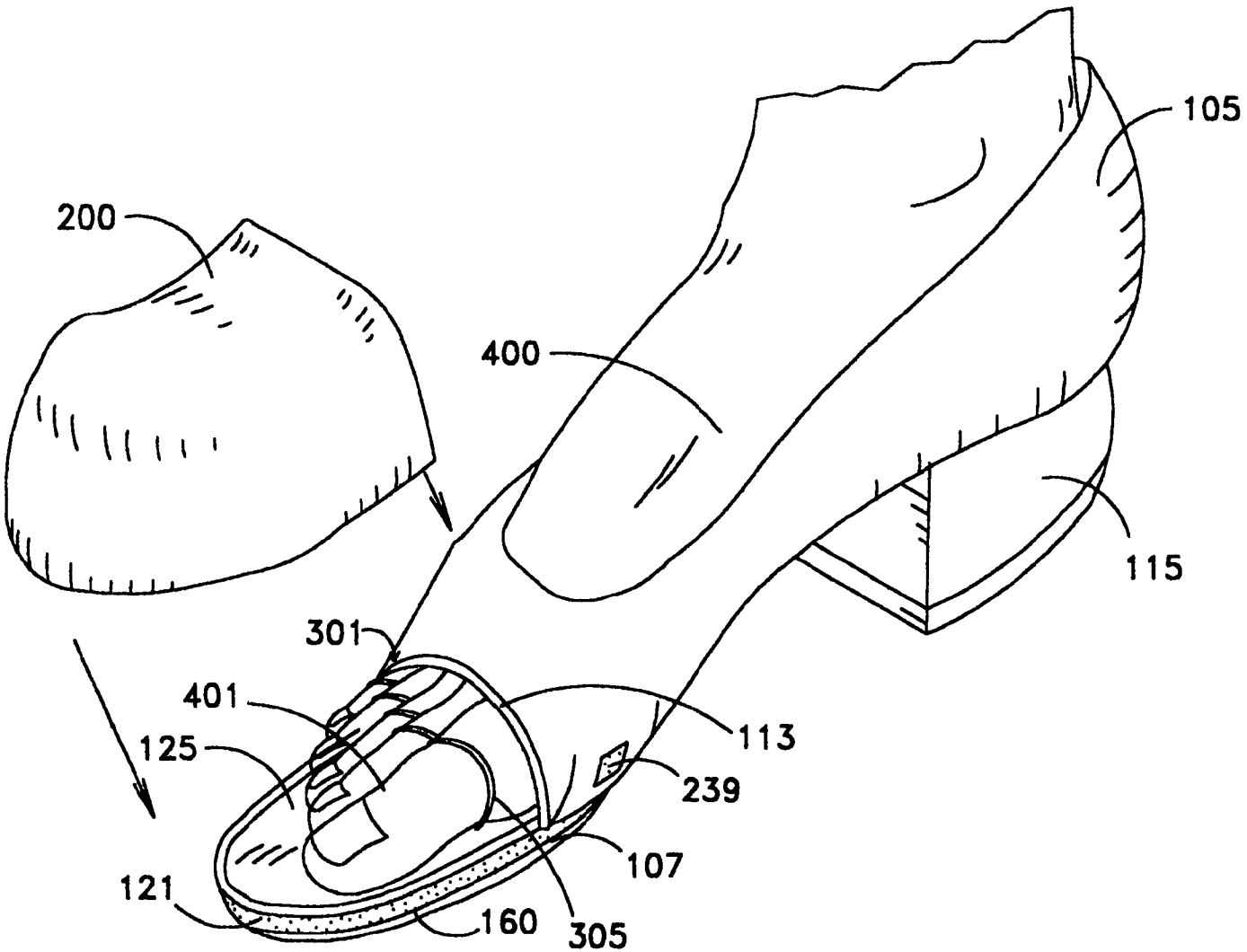
FIG. 13 shows a view of the shoe with a toe retainer.

In the embodiment of FIG. 13 the toe retainer 301 comprises one or more loops 305 attached to the sole 107 of the shoe 100. The loops 305 are sized and shaped to be placed over the toes. It is preferred that five loops 305, one for each toe, be used, but in an alternative embodiment multiple toes could be placed into the same loop 305. When the shoe 100 is put on, the toes will be slid into the appropriate loop 305 placing the loop 305 behind the toenail, generally in the region of the middle or proximal row of phalanges behind the toenail. The toe is then effectively tied to the sole 107 of the shoe 100 and will remain in contact with the shoe 100. The loops 305 may either be permanently attached to the sole 107 or may be removably attached so that they can be released to allow the toes increased movement once the nail polish has dried. In operation, the shoe 100 would be used as follows. The user would generally have her pedicure completed up until the application of polish to the toenails, which is usually the last step. The foot would then be placed into the shoe 100 with the toe cover 200 removed. The toenails can therefore be accessed by the person performing the pedicure who can paint the toenails while the foot is in the main body 101 of the shoe 100. Once the painting process is completed to satisfaction, the polish would generally be allowed to dry for as long as possible with the toe cover 200 removed and the user remaining sedentary.

Once the user is ready to leave the spa, she will reconnect the toe cover 200 to the shoe 100 completing the shoe's look and making it appear to be a singular structure. The upper surface 109 or toe retainer 301 will keep the toes from fully curling upward and impacting or touching an inner surface 201 of the toe cover 200. Further, as the main body 101 retains the heel and ankle, the foot will generally be unable to slide forward or rearward in the shoe 100 any significant distance also inhibiting damage to the nails. Thus, even wet polish on the toes will be inhibited from contacting the inner surface 201 of the toe cover 200.

The shoe 100 is generally designed so that a user can walk relatively normally while wearing the shoe 100 without being concerned about potential damage to the nail polish. Further as the toes are now relatively encased by the shoe 100 (specifically the toe cover 200, the polish is also protected from external conditions of concern. In particular, the design of the shoe 100 can ward off dust and particulates In order to better improve and accelerate polish drying while the toe cover 200 is in place, the shoe 100 may include an inconspicuous ventilation system. In an embodiment, there may be small holes, generally located towards the upper-sides of the shoe 100 to inhibit the entrance of dust, particulates or surface water, placed in the shoe 100. The holes will generally be located in the main body 101 around the middle of the foot, but may also be located in the upper surface of the toe cover 200. The holes will allow air to pass in and out of the shoe 100 accelerating the drying of the nail polish. Movement of the shoe 100 during walking can further enhance airflow into and out of the holes. This can also improve drying by providing a generally dryer environment inside the shoe 100 which can also improve the resultant quality of the polish appearance. These holes can be incorporated into a design for the shoe 100 and can be sized and shaped to minimize or eliminate water intrusion even in wet conditions.

The shoe 100 will generally be designed to be worn after a pedicure to camouflage that a pedicure has been obtained and therefore will need to be useable in a wide variety of circumstances. In particular, the user may need to go to work or otherwise be out and about after the pedicure. The shoe 100, therefore, will preferably be both functional for use in a variety of conditions, and have an aesthetical appearance suitable for a variety of situations. In particular, in an embodiment of the invention, the function and structure of the shoe 100 can be disguised by outward appearance so it is not apparent that the shoe 100 is for protecting a pedicure.

To meet this intent, the shoe 100 may be designed utilizing any popular style of shoe and may be provided with an athletic, professional, or elegant design. The shoe 100 may include decorative accessories such as stones, bows, etc. The style of the shoe 100 may change to accommodate different tastes in shoes or depending upon the designer's discretion. It may also include a variety of structural elements suitable for different tasks. For instance specially designed soles and comfort mechanisms, as known to those of ordinary skill in the art, may be provided to allow the shoe 100 to be worn for a significant period of time, even if such length of time is beyond that necessary for the polish to dry.

In another embodiment, a single shoe 100 may provide a variety of styles and options. In an embodiment, the toe cover 200 is interchangeable with other toe covers 200 providing for a single shoe 100 with a multitude of appearances and styles and potential functionality. For instance, the shoe 100 may be constructed of a fairly solid color scheme without significant decoration. A plurality of toe covers 200 may be provided which match or complement the main body color, but include surface decoration of many different styles.

Figure 14:
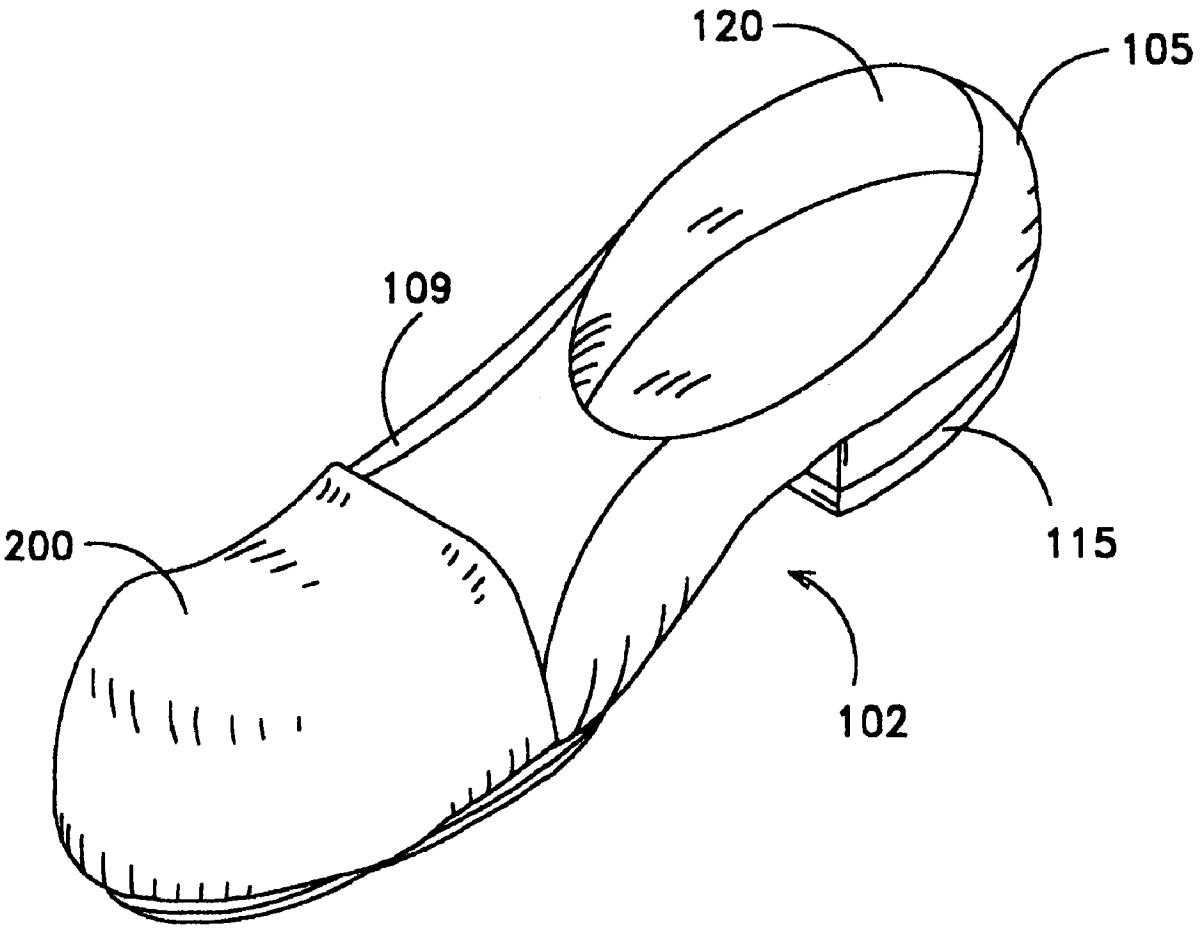
FIG. 14 shows a view of the casual shoe with the toe cover in place.

Another embodiment of the present invention is shown in FIG. 14. This embodiment is a casual shoe 102 version of the present invention suitable for casual occasions. The general surrounding structure of the casual shoe 102 shown in FIG. is maintained in a similar manner to shoe 100 shown in FIGS. 1 through 13. The casual shoe 102 has a shorter heel and a larger upper surface 109. The casual shoe 102 version functions in the same manner as shoe 100.

Figure 15:
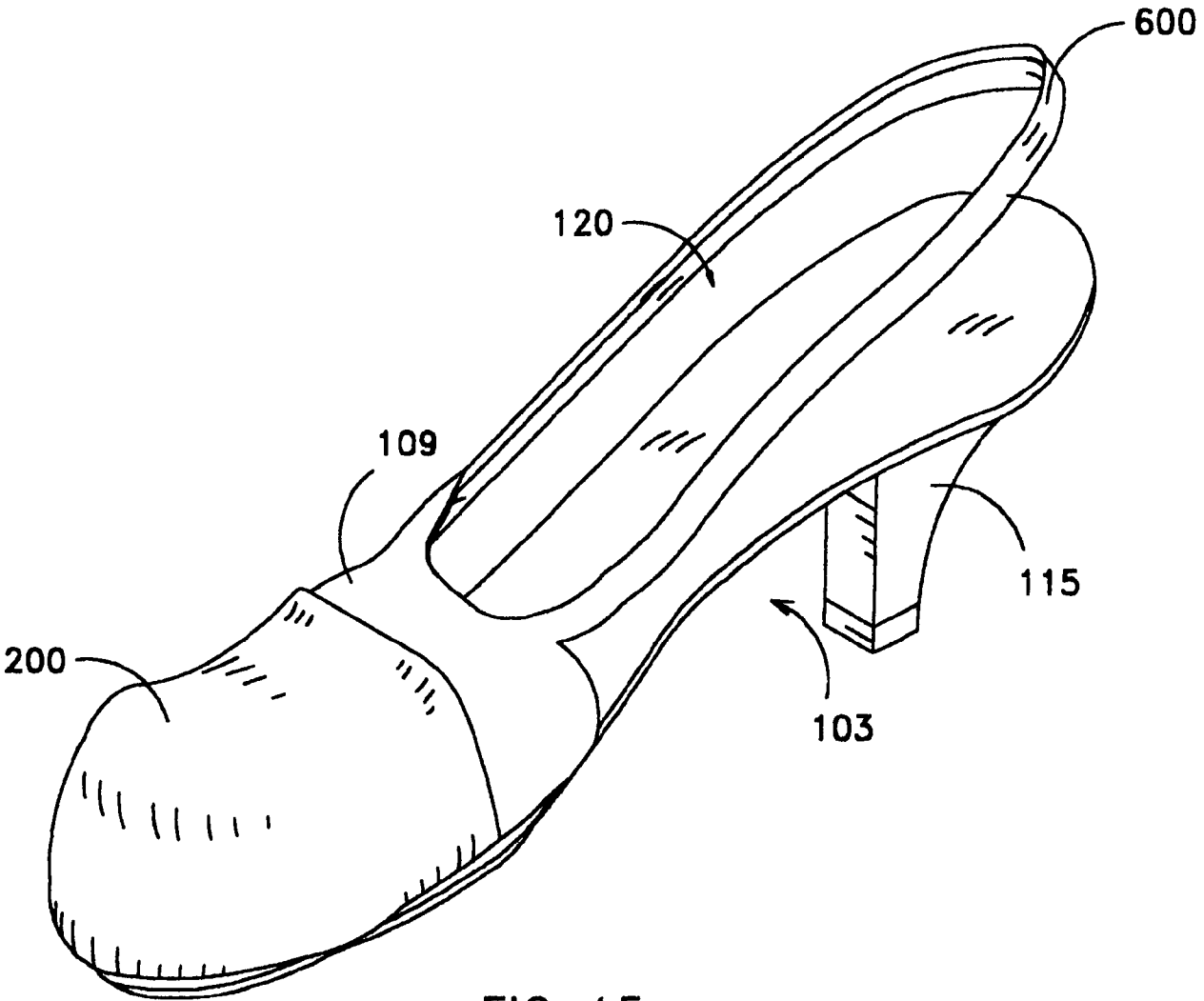
FIG. 15 shows a view of the fashionable shoe with the toe cover in place.

A still further embodiment of the present invention is shown in FIG. 15. This embodiment is a fashionable shoe 103 version of the present invention, suitable for dress-casual events such as a cocktail party. The general surrounding structure of the fashionable shoe 103 shown in FIG. 15 is maintained in a similar manner to shoe 100 shown in FIGS. 1 through 13. The fashionable shoe 103 has a narrower heel and a smaller upper than the shoe 100. The fashionable shoe 103 version functions in the same manner as shoe 100, however, the rear 105 of the fashionable shoe 103 may comprises a strap 600 or other structure to prevent backward movement of the foot. The strap 600 wraps around the heel or back of the foot. The foot is still securely retained in the fashionable shoe 103, even though much of the side and rear material has been removed and replaced with the strap 600 to give a different style appearance.

A still further embodiment of the present invention includes a hidden engaging mechanism, such as, a magnetic strip hidden inside or under the material forming the upper surface 109. The magnetic strip would then mate to an oppositely charged magnetic strip in the perimeter of the sole 160. The hidden engaging mechanism serves the same purpose as the hook 121 and loop fasteners 221, but allows the connection to be hidden from view, even when the toe cover 200 is removed. This can provide for still further style options because it allows the shoe to be worn open-toed once the nail polish has dried sufficiently while still camouflaging the shoes purpose.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

What is claimed:

1. Footwear for use during or after a pedicure, comprising:

a main body for receiving a foot;

a toe cover that is repeatedly completely detachable and attachable to the main body or a sole of the footwear, the toe cover comprising a concave top surface leading up to a front portion of the toe cover that is higher than the concave surface, and the toe cover allows toes of a wearer of the footwear to have a range of flexion which occurs while walking without the toes touching the toe cover;

a rear portion of the footwear that wraps around a rear of the foot to stabilize the foot;

an upper surface forming an opening through which the toes are extended;

the upper surface covering a portion of the foot, and the upper surface reducing or inhibiting the upward movement of the toes;

the toe cover comprising a top section that is not attached to the upper surface; and the toe cover resting on the upper surface.

2. The footwear according to claim 1, wherein a bottom edge of the toe cover detachably connects to the main body or the sole of the footwear.

3. The footwear according to claim 1, wherein the toe cover is generally made of a material more rigid than the main body.

4. The footwear according to claim 1, wherein the toe cover includes an arcuate shaped opening edge, and a top section of the opening edge is not fixed or connected to the upper surface.

5. The footwear according to claim 1, wherein the toe cover includes an arcuate shaped opening edge, and a top section of the opening edge is not fixed or connected to the upper surface, and the upper surface has an arcuate shaped edge to complement the arcuate shaped opening edge.

6. The footwear according to claim 1, wherein the toe cover includes an opening edge, and a top section of the opening edge rests on the upper surface just above a point of inflection for toes.

7. The footwear according to claim 1, wherein the upper surface is not removable from the footwear.

8. The footwear according to claim 1, wherein the upper surface reduces the range of flexion of the toes.

9. The footwear according to claim 1, wherein the toe cover includes the concave surface, and the front portion of the toe cover is higher than a top section of an opening edge of the toe cover.

10. The footwear according to claim 1, wherein the toe cover defines a cavity to allow the toes to flex without the toes contacting the toe cover.

11. The footwear according to claim 1, wherein the toe cover is repeatedly detachable and attachable to a perimeter of the sole.

12. The footwear according to claim 1, wherein the footwear and its upper surface bend and flex while the toe cover remains rigid.

13. The footwear according to claim 1, wherein the upper surface covers a point where toes of a wearer protrude from the wearer's foot.

14. The footwear according to claim 1, further comprising a toe retainer.

15. The footwear according to claim 1, wherein a strap connects to the upper surface and wraps around the foot.

16. Footwear for use during or after a pedicure, comprising:

a main body for receiving a foot;

a toe cover that is repeatedly completely detachable and attachable to the main body or a sole of the footwear;

a rear portion of the footwear that wraps around a rear of the foot to stabilize the foot;

an upper surface forming an opening through which the toes are extended;

the upper surface covering a portion of the foot, and the upper surface reducing or inhibiting the upward movement of the toes; and the toe cover comprising an opening edge, a top section of the opening edge is not attached to the upper surface, wherein a front portion of the top surface of the toe cover is taller than the top section of the opening edge, and the toe cover resting on the upper surface.

* * * * *